US009212446B2

(12) United States Patent
Park

(10) Patent No.: US 9,212,446 B2
(45) Date of Patent: Dec. 15, 2015

(54) LAUNDRY MACHINE AND WASHING METHOD WITH STEAM FOR THE SAME

(75) Inventor: Seog Kyu Park, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 1422 days.

(21) Appl. No.: 11/629,127

(22) PCT Filed: Feb. 28, 2006

(86) PCT No.: PCT/KR2006/000706

§ 371 (c)(1),
(2), (4) Date: Feb. 4, 2009

(87) PCT Pub. No.: WO2007/081069

PCT Pub. Date: Jul. 19, 2007

(65) Prior Publication Data

US 2009/0139036 A1 Jun. 4, 2009

(30) Foreign Application Priority Data

Jan. 11, 2006 (KR) ..... 10-2006-0003103
Jan. 11, 2006 (KR) ..... 10-2006-0003104
Jan. 11, 2006 (KR) ..... 10-2006-0003105

(51) Int. Cl.
*D06F 35/00* (2006.01)
*D06F 39/00* (2006.01)

(52) U.S. Cl.
CPC ..... *D06F 35/006* (2013.01); *D06F 35/005* (2013.01); *D06F 39/008* (2013.01); *D06F 39/005* (2013.01)

(58) Field of Classification Search
CPC ..... D06F 33/02; D06F 35/005; D06F 39/008; D06F 35/006
USPC ..... 65/5 C, 12.07–12.09, 15–17, 207; 8/149.1–149.3; 68/5 C, 12.07–12.09, 68/15–17, 207
See application file for complete search history.

(56) References Cited

U.S. PATENT DOCUMENTS 3,660,013 A * 5/1972 Payet et al. ..... 8/116.4
3,696,523 A * 10/1972 Beeley et al. ..... 34/216

(Continued)

FOREIGN PATENT DOCUMENTS

CN 1580359 A 2/2005
CN 1614118 5/2005

(Continued)

OTHER PUBLICATIONS

Machine translation of CN 101080526 B, dated Jul. 2011.*

*Primary Examiner* — Joseph L Perrin
*Assistant Examiner* — Kevin G Lee
(74) *Attorney, Agent, or Firm* — Dentons US LLP

(57) ABSTRACT

Disclosed herein are a washing method and a laundry machine adopting the same, and more particularly, a steam washing method and a laundry machine that is capable of washing laundry only using steam and effectively performing a washing operation under the optimum operation condition. The steam washing method includes a selection step of allowing a user to select a steam washing course, in which a washing operation is performed only using steam, through an input unit, and an operation step of performing an operation based on the steam washing course while controlling at least one of a steam supply unit, a water supply unit, and a drum drive unit. The laundry machine includes an input unit for selecting a steam washing course, in which a washing operation is performed only using steam, among various washing courses, a steam supply unit for generating steam and supplying the generated steam to a tub or a drum, and a control unit for performing a control operation such that laundry received in the drum can be washed only using the steam when the steam washing course is inputted by the input unit.

41 Claims, 9 Drawing Sheets

(56) References Cited

U.S. PATENT DOCUMENTS

| | | | | | |
|---|---|---|---|---|---|
| 3,732,628 | A | * | 5/1973 | Blevens et al. | 34/389 |
| 3,849,815 | A | * | 11/1974 | Frauendorf | 8/149.1 |
| 4,084,237 | A | * | 4/1978 | Beachem et al. | 700/90 |
| 4,607,408 | A | * | 8/1986 | Didier et al. | 8/159 |
| 5,723,847 | A | * | 3/1998 | Boldt | 219/506 |
| 6,502,265 | B2 | * | 1/2003 | Blair et al. | 8/159 |
| 6,585,781 | B1 | * | 7/2003 | Roseen | 8/149.1 |
| 6,954,995 | B2 | * | 10/2005 | Kitamura et al. | 34/597 |
| 7,565,822 | B2 | * | 7/2009 | Park et al. | 68/15 |
| 7,647,794 | B2 | * | 1/2010 | Park et al. | 68/12.23 |
| 2001/0049846 | A1 | * | 12/2001 | Guzzi et al. | 8/158 |
| 2004/0118008 | A1 | * | 6/2004 | Jeong et al. | 34/425 |
| 2004/0187529 | A1 | * | 9/2004 | Kim et al. | 68/207 |
| 2004/0255391 | A1 | * | 12/2004 | Kim et al. | 8/149.3 |
| 2005/0034248 | A1 | * | 2/2005 | Oh et al. | 8/149.3 |
| 2005/0034250 | A1 | * | 2/2005 | Oh et al. | 8/159 |
| 2005/0092035 | A1 | | 5/2005 | Shin et al. | |
| 2005/0132503 | A1 | * | 6/2005 | Yang et al. | 8/149.3 |
| 2005/0144734 | A1 | * | 7/2005 | Yang et al. | 8/149.3 |
| 2005/0183208 | A1 | * | 8/2005 | Scheper et al. | 8/142 |
| 2005/0252250 | A1 | | 11/2005 | Oh et al. | |
| 2005/0262644 | A1 | * | 12/2005 | Oak et al. | 8/158 |

FOREIGN PATENT DOCUMENTS

| | | | | |
|---|---|---|---|---|
| CN | 1637191 | | | 7/2005 |
| CN | 1637191 | A | | 7/2005 |
| CN | 101080526 | B | * | 7/2011 |
| EP | 1 464 750 | | | 10/2004 |
| EP | 1 507 028 | | | 2/2005 |
| EP | 1 507 033 | | | 2/2005 |
| EP | 1507028 | A1 | | 2/2005 |
| EP | 1 600 545 | | | 11/2005 |
| EP | 1605090 | A2 | | 12/2005 |
| JP | 09038379 | | | 2/1997 |
| JP | 11009883 | | | 1/1999 |
| JP | 3075120 | U | | 2/2001 |
| JP | 2003093775 | | | 4/2003 |
| JP | 2003311068 | | | 11/2003 |
| JP | 2003311084 | | | 11/2003 |
| JP | 2003326079 | | | 11/2003 |
| JP | 2004-167131 | | | 6/2004 |
| JP | 2004-298614 | | | 10/2004 |
| JP | 2005-193003 | | | 7/2005 |
| KR | 10-1997-0011098 | | | 3/1997 |
| KR | 1020050017488 | | * | 2/2005 |
| KR | 10-0531333 | | | 11/2005 |
| SU | 1481303 | A1 | | 5/1980 |
| WO | WO 2006/001612 | | | 1/2006 |

* cited by examiner

LAUNDRY MACHINE AND WASHING METHOD WITH STEAM FOR THE SAME

This application claims priority to International application No. PCT/KR2006/000706 filed on Feb. 28, 2006, Korean Application No. 10-2006-0003103 filed on Jan. 11, 2006, Korean Application No. 10-2006-0003104 filed on Jan. 11, 2006, Korean Application No. 10-2006-0003105 filed on Jan. 11, 2006, all of which are incorporated by reference, as if fully set forth herein.

TECHNICAL FIELD

The present invention relates to a washing method and a laundry machine adopting the same, and more particularly, to a steam washing method and a laundry machine that is capable of washing laundry only using steam and effectively performing a washing operation under optimum operation conditions.

BACKGROUND ART

Generally, laundry machines include a pulsator-type washing machine whose drum is mounted vertically, a drum washing machine whose drum is mounted horizontally, a washing-and-drying machine having a drying function, and a clothes drying machine that performs only a laundry drying operation.

Among the above laundry machines, the pulsator-type washing machine, the drum washing machine, and the washing-and-drying machine normally perform a washing-related operation using washing water.

Especially, a laundry machine having a steam generating apparatus that is capable of supplying steam during a washing operation has been disclosed recently.

In the conventional laundry machine having the above-described steam generating apparatus, however, the steam supplied from the steam generating apparatus is used only to assist the washing operation. Specifically, a steam washing operation, in which laundry is washed only using steam, is not performed without a rinsing operation or a spin-drying operation.

Also, consumers do not utilize the function of the steam generating apparatus due to increase in power consumption necessary to operate the steam generating apparatus.

For this reason, there is a necessity to positively use the function of the steam generating apparatus in the laundry machine having the steam generating apparatus. On the other hand, there is a necessity to apply the steam generating apparatus to the drying machine as well as the washing machine that washes laundry using washing water such that the drying machine has various functions.

DISCLOSURE OF INVENTION

An object of the present invention devised to solve the problem lies on a steam washing method that is capable of washing laundry using a minimum amount of power and a minimum amount of washing machine when the amount of the laundry is relatively small, the laundry has low contamination, or the laundry is washed only to remove smells from the laundry, and a laundry machine adopting such a steam washing method.

Another object of the present invention devised to solve the problem lies on a washing method that is capable of performing a steam washing operation under the optimum operation condition, thereby maximizing the steam washing efficiency, and a laundry machine adopting such a steam washing method.

The object of the present invention can be achieved by providing a steam washing method comprising: a selection step of allowing a user to select a steam washing course, in which a washing operation is performed only using steam, through an input unit; and an operation step of performing an operation based on the steam washing course while controlling at least one of a steam supply unit, a water supply unit, and a drum drive unit.

It is preferable that, when the steam washing course is selected at the selection step, information of the operation based on the steam washing course be provided to the user, and it is preferable that, when the steam washing course is selected at the selection step, only the manipulation necessary to perform the operation based on the steam washing course be allowed by the input unit.

At the operation step, an operation condition may be decided according to an initial factor at the time when the steam washing course is processed. Specifically, the operation condition may be decided differently depending upon the initial factor.

Here, the initial factor may be the load amount of laundry initially received in the drum such that the laundry is washed using the steam. The load amount of the laundry may be selected by the user, or may be measured by means of an additional load amount measuring apparatus.

On the other hand, the operation condition may include at least one of the amount of water supplied to the steam supply unit, the interior temperature of a tub or a drum necessary to perform the operation based on the steam washing course, the operation time of the steam washing course, the steam supply cycle, the rotating speed of the drum, and the alternating rotation cycle of the drum.

Also, the initial factor may be the initial interior temperature of the tub or the drum. Specifically, the operation condition may be decided differently depending upon the initial temperature. More specifically, the operation condition is decided based on an operation progress temperature and/or an operation progress time depending upon the result of comparison between the initial temperature and a reference temperature range.

For example, the operation condition may be decided based on the operation progress temperature when the initial temperature is out of the reference temperature range. This means that the steam washing is carried out until the interior temperature of the tub or the drum reaches the predetermined operation progress temperature.

Here, the operation progress temperature is decided differently depending upon the load amount of the laundry. More specifically, the operation progress temperature is decided such that the operation progress temperature is increased in proportion to an increase in the load amount of the laundry. This means that the amount of steam used to perform the steam washing is increased as the operation progress temperature is increased. Preferably, the reference temperature range is 10 to 30° C.

On the other hand, the operation condition may be decided based on the operation progress time when the initial temperature is within the reference temperature range. This means that the steam washing is carried out for the predetermined period of time.

Here, the operation progress time is decided differently depending upon the load amount of the laundry. More specifically, the operation progress time may be decided such that the operation progress time is increased in proportion to an increase in the load amount of the laundry. This means that the amount of steam used to perform the steam washing is increased as the operation progress time is increased.

In the steam washing method, the operation step comprises: a water supply step of supplying water only to the steam supply unit such that the washing operation is performed only using steam; a steam generation step of generating steam in the steam supply unit; and a steam supply step of supplying the generated steam to a tub or a drum.

Here, the operation step may further comprise: a tumble step of rotating the drum; and a water draining step of draining water from the tub when the water level in the tub is higher than a predetermined water level. More specifically, the water draining step may be carried out before the steam supply step is carried out, or may be continuously carried out while the steam supply step is carried out.

Preferably, the steam washing method further comprises: a drum rotation step of rotating the drum after the operation step is completed. The drum rotation step may be carried out until a door of the laundry machine is opened. Of course, the drum rotation step may be carried out for a predetermined time cycle or continuously until the input unit is manipulated to interrupt the operation individually or simultaneously with the above-described method.

In another aspect of the present invention, provided herein is a laundry machine comprising: an input unit for selecting a steam washing course, in which a washing operation is performed only using steam, among various washing courses; a steam supply unit for generating steam and supplying the generated steam to a tub or a drum; and a control unit for performing a control operation such that laundry received in the drum can be washed only using the steam when the steam washing course is inputted by the input unit.

It is preferable that the control unit control a water supply unit such that the water supply unit can supply water to only the steam supply unit in the steam washing course, whereby the washing operation is performed only using the steam. It is also preferable that the control unit control an operation condition differently according to the initial factor at the time when the steam washing course is processed.

Here, the initial factor is the load amount of laundry initially received in the drum such that the laundry is washed using the steam or the initial interior temperature of the tub or the drum.

BRIEF DESCRIPTION OF DRAWINGS

The accompanying drawings, which are included to provide a further understanding of the invention, illustrate embodiments of the invention and together with the description serve to explain the principle of the invention.

In the drawings.

BEST MODE FOR CARRYING OUT THE INVENTION

Reference will now be made in detail to the preferred embodiments of the present invention, examples of which are illustrated in the accompanying drawings, i.e., FIGS. 1 to 7.

First, a laundry machine that performs a steam washing method according to the present invention will be described. In this case, the laundry machine may be a general washing machine, a washing-and-drying machine, or a clothes drying machine.

Figure 1:
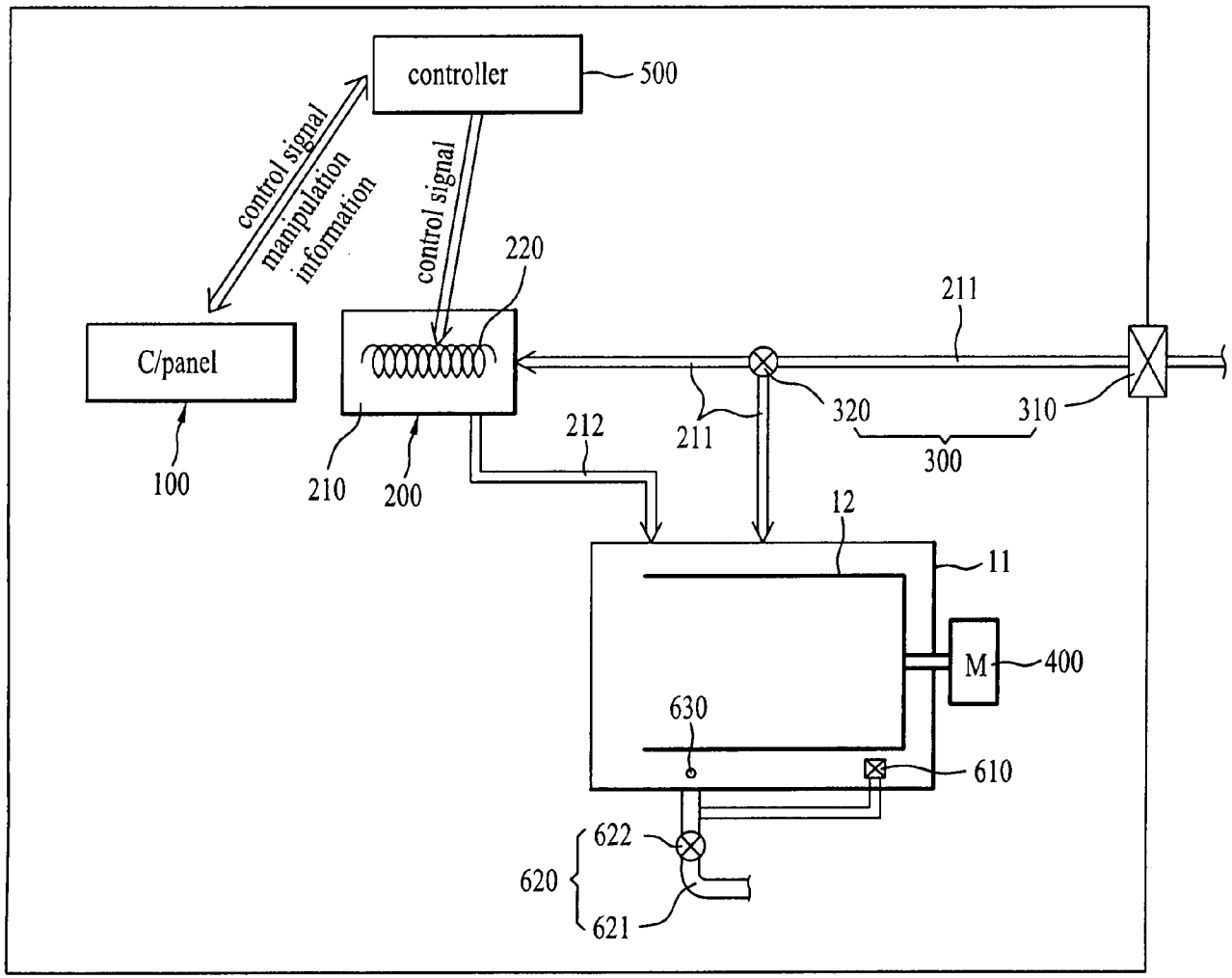
FIG. 1 is a schematic block diagram illustrating the structure of a laundry machine according to a preferred embodiment of the present invention.

As shown in FIG. 1, the laundry machine according to the present invention includes an input unit 100, which is shown as a "C/panel" in the drawing, a steam supply unit 200, a water supply unit 300, a drum drive unit 400, and a control unit 500, which is shown as a "controller" in the drawing.

The respective components constituting the laundry machine will be described hereinafter in more detail.

Figure 2:
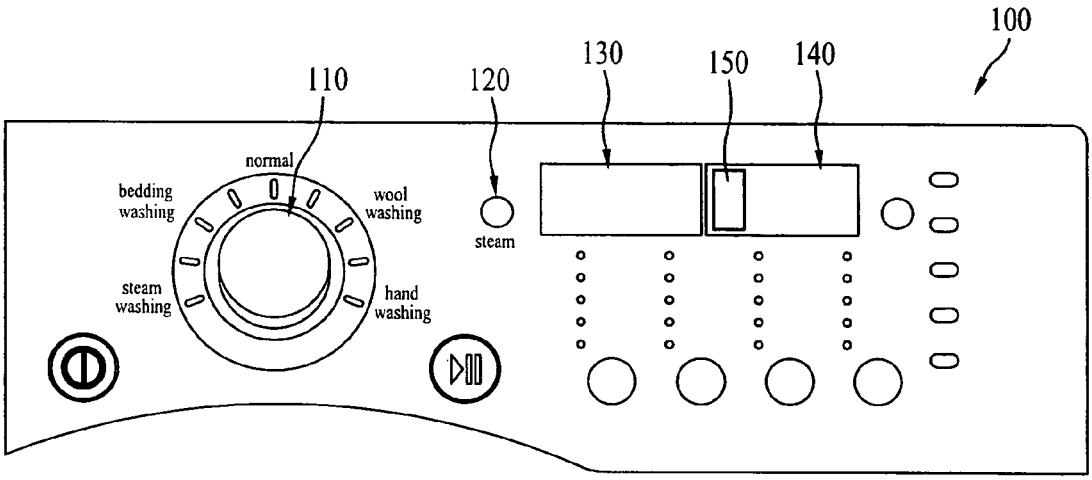
FIG. 2 is a front view illustrating the control assembly of the laundry machine according to the preferred embodiment of the present invention.

First, the input unit 100 will be described with reference to FIG. 2. Typically, the input unit 100 is a control panel mounted at the front part of the laundry machine. The input unit 100 is shown as the control panel in FIG. 2.

The input unit 100 is a unit for allowing a user to manipulate the laundry machine. The input unit 100 may include a course selection part 110, a load amount selection part 120, and a display part 130. Specifically, the input unit 100 serves to allow the user to select a washing course and to provide the user with washing information.

The course selection part 110 is constructed such that the user can select various course-based operations, which can be performed using the laundry machine.

According to the present invention, the course selection part 100 of the input unit allows the user to select a steam washing course, in which laundry is washed only using steam, in addition to various washing courses, which are normally used, (i.e., a washing course for washing laundry using water supplied into a tub).

Also, the course selection part 110 may be constructed in the shape of various buttons or a rotary knob. In the preferred embodiment of the present invention, the course selection part 110 is constructed in the shape of the rotary knob.

The load amount selection part 120 is a part for allowing the user to select the load of laundry, for which the steam washing course is processed, for example, the number or the weight of clothes.

The load amount selection part 120 may be also constructed in the shape of various buttons or a dial knob. In the preferred embodiment of the present invention, the load amount selection part 120 is constructed in the shape of a single button. In this case, the load amount is successively changed whenever the single button is pressed, which is advantageous in that it is possible to change the load amount using the minimum structure. However, it is also possible to automatically detect the load amount of laundry received in a drum using a sensor for detecting the load amount of the laundry without the provision of the load amount selection part 120. However, it is preferable for the user to select the load amount on condition that the amount of the laundry to be washed using the steam is small, and, especially, the laundry to be washed using the steam is a specific type of clothes (for example, dress shirts).

The display part 130 is a part that displays various kinds of information. More specifically, the display part 130 may be constructed using an LED or a LCD. Furthermore, the display part 130 may be constructed to display the current operation state, elapsed time (or remaining time), etc.

According to the preferred embodiment of the present invention, on the other hand, the input unit 100 further includes a steam operation display part 140. Here, the steam operation display part 140 is a part that provides the user with information as to whether the steam washing operation is carried out or not. The steam operation display part 140 may be a part of the display part 130, or, as shown in the drawing, the steam operation display part 140 may be constructed using a lamp or an LED such that the steam operation display part 140 is separated from the display part 130.

In addition, according to the preferred embodiment of the present invention, the input unit 100 further includes a load amount display part 150. Here, the load amount display part 150 is a part that displays the load amount selected by the load amount selection part 120. Preferably, the load amount display part 150 is constructed in the shape of an LED window.

Of course, the load amount display part 150 may be constructed in the shape of an LCD window. In addition, the load amount display part 150 may be constructed such that the load amount display part 150 is integrated with the above-described display part 130. In other words, the display part 130 may be constructed such that the display part 130 also serves to perform the function of the load amount display part 150.

Next, the steam supply unit 200 will be described with reference to FIG. 1.

First, the steam supply unit 200 is constructed such that the steam supply unit 200 generates steam, which is used in a steam washing course, and supplies the steam to a tub 11 or a drum.

The steam supply unit 200 includes a case 210 and a heater 220. Here, the case 210 is a tank for storing water used to generate steam. The heater 220 is a heating element for evaporating the water stored in the case 210 and for generating steam. The heater 220 is mounted in the case 210.

To the case 210 is connected a water supply pipe 211 and a steam supply pipe 212. The water supply pipe 211 is connected to the water supply unit 300 such that water is supplied to the water supply pipe 211 from the water supply unit 300. The steam supply pipe 212 is connected to the tub 11 such that steam generated in the case 210 is supplied to the tub 11 or the drum.

Of course, in the case that the case 210 is made of a material that can be heated to a high temperature (for example, metal or ceramic), the heater 220 may be mounted either outside the case 210 or in the wall of the case 210 such that the case 210 itself can be heated by the heater 220.

Subsequently, the water supply unit 300 will be described with reference to FIG. 1.

The water supply unit 300 is constructed such that the water supply unit 300 supplies water, which will be used to generate steam, to the steam supply unit 200.

In this case, the water supply unit includes a water supply pipe 211, which is connected to the case 210 of the steam supply unit 200. The other end of the water supply pipe 211 is exposed to the outside of the laundry machine, and is then connected to a water service pipe (not shown).

Also, the water supply unit 300 further includes a water supply valve 310. In this case, the water supply valve 310 is mounted on the pipe line of the water supply pipe 211 for selectively opening and closing the water supply pipe 211.

On the other hand, it is more preferable that the water supply unit 300 be constructed such that the water supply unit 300 can supply washing water into the tub 11 of the laundry machine. To this end, the water supply pipe 211 constituting the water supply unit 300 communicates with the interior of the tub 11 according to the preferred embodiment of the present invention.

In this case, the water supply pipe 211 is constructed such that the water supply pipe 211 includes at least two branch pipes, one end of which is connected to the case 210 of the steam supply unit 200, and the other end of which communicates with the interior of the tub 11. At the branch point of the water supply pipe 211 is also mounted a flow-channel valve 320 for guiding the flow of the supplied water.

As shown in FIG. 1, it is possible to selectively or simultaneously supply washing water to the steam supply unit 200 and the tub 11 through the flow-channel valve 320 of the water supply unit 300. In this case, however, the construction of the flow-channel valve 320 may be complicated, or the control of the flow-channel valve 320 may be difficult. For this reason, the water supply unit 300 may be constructed such that the water supply from the water supply unit 300 to the steam supply unit 200 and the water supply from the water supply unit 300 to the tub 11 are separately performed unlike the construction shown in FIG. 1. In this case, there is provided an additional water supply valve, which is simply turned on/off.

Subsequently, the drum drive unit 400 will be described.

First, the drum drive unit 400 includes a motor driven such that the drum 12, in which the laundry is received, can be rotated by the motor when a steam washing operation is carried out. In this case, the drum 12 is rotatably mounted in the tub 11.

Especially, it is preferable to construct the drum drive unit 400 such that the drum drive unit 400 can be directly coupled with the drum via a shaft. Of course, the drum drive unit 400 may be constructed such that the drum drive unit 400 can indirectly drive the drum 12 using a belt and a belt pulley, although not shown in the drawing.

Also, it is preferable that the drum drive unit 400 be constructed such that the drum can be rotated at a speed lower than 100 rpm when the steam washing operation is carried out. More preferably, the drum drive unit 400 is constructed such that the drum can be rotated at a speed of 40 to 50 rpm.

Most preferably, the drum drive unit 400 is constructed such that the drum 12 can be alternately rotated in opposite directions in addition to one-direction rotation of the drum 12.

Subsequently, the control unit 500 will be described in detail.

The control unit 500 is constructed such that the control unit 500 is cooperated with the input unit 100, and, on the other hand, the control unit 500 controls the operations of the steam supply unit 200, the water supply unit 300, and the drum drive unit 400.

In this case, while the control unit 500 is cooperated with the input unit 100, the control unit 500 controls the amount of steam supplied to the tub 11 or the drum 12 from the steam supply unit 200, the steam supply time, or the steam supply cycle according to the load amount selected by the load amount selection part 120, and controls the operations of the water supply unit 300 and the drum drive unit 400.

On the other hand, the laundry machine according to the preferred embodiment of the present invention may further include a water level detection unit 610 as shown in FIG. 1. Here, the water level detection unit 610 is constructed to detect the level of water existing in the tub 11. Preferably, the water level detection unit 610 is constructed using a water level sensor.

Of course, the water level detection unit 610 may be constructed using a pressure gauge, which detects pressure variations relating to the level of water existing in the tub 11 to determine the water level.

In addition, it is preferable that the tub 11 be further provided with a water level detection unit 610 for selectively draining water from the tub 11. Here, the water draining unit 620 is constructed such that the water draining unit 620 drains water, under the control of the control unit 500, when the water level detected by the water level detection unit 610 is higher than a predetermined water level. The water draining unit 620 includes a water draining pipe 621 and a water draining pump 622.

The water draining pipe 621 is connected to the lower part of the tub 11 for draining the water from the tub 11 to the outside of the laundry machine. Also, the water draining pump 622 is mounted at the water draining pipe 621. The water draining pump 622 is driven such that the water is pumped out from the tub 11, and is then drained out of the laundry machine through the water draining pipe 621. The structure of the water draining unit 620 is schematically shown in FIG. 1.

On the other hand, the laundry machine according to the preferred embodiment of the present invention may further include a temperature detection unit 630.

The temperature detection unit 630 is constructed such that the temperature detection unit 630 detects the interior temperature of the tub 11 or the drum 12 and transmits the detected value to the control unit 500. Here, the temperature detection unit 630 may be a normal temperature sensor.

A steam washing method according to a preferred embodiment of the present invention, which is carried out using the above-described laundry machine, will now be described.

First, FIGS. 3 to 7 are flow charts schematically illustrating the steam washing method according to the preferred embodiment of the present invention.

In this case, the steam washing is an operation course for washing laundry only using steam. Specifically, the laundry is washed only using the steam in the steam washing without performing the existing washing operation, the rinsing operation, and spin-drying operation.

Especially, the steam washing is an operation course for performing a laundry washing operation such that simple contaminants or smells can be effectively removed from a small amount of laundry within a short period of time. In other words, the steam washing means a washing course in which the washing time and the amount of washing water used when the washing operation is carried out are remarkably decreased. More specifically, the steam washing means a steam washing course in which the laundry is washed only using the steam.

At this time, laundry to be washed using steam is received in the drum 12 constituting the laundry machine. Of course, a contaminant-transfer cloth (not shown), to which the contaminants attached to the laundry are transferred, may be also received in the drum 12 in addition to the laundry.

Figure 3:
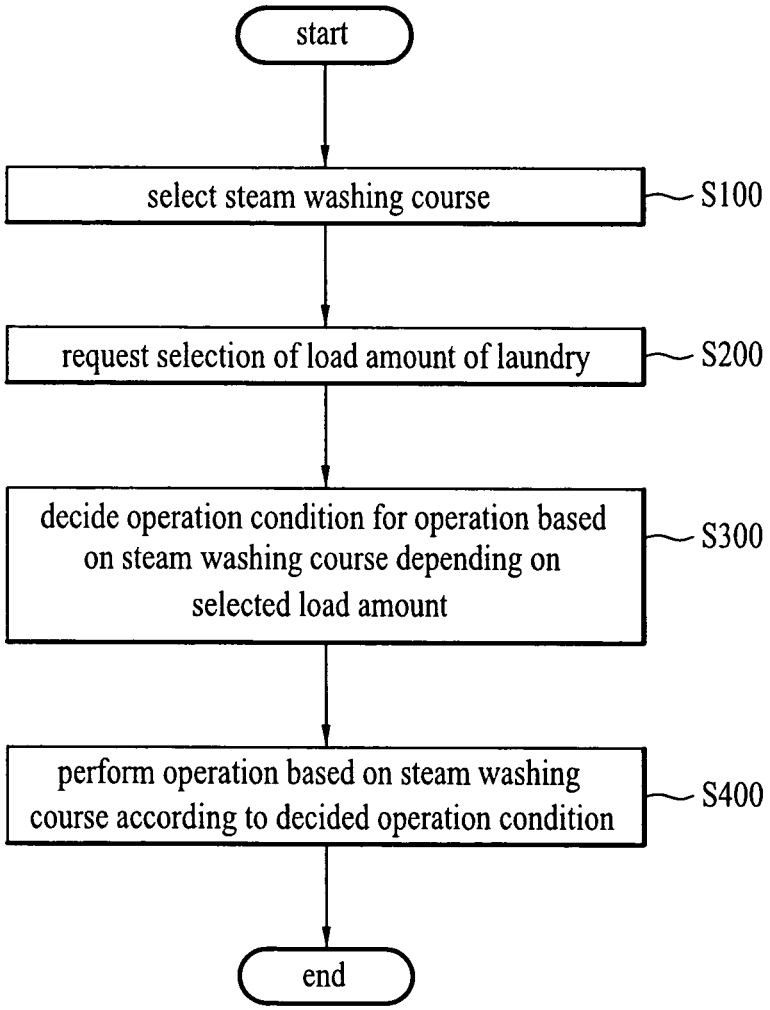
FIG. 3 is a flow chart schematically illustrating a steam washing method for a laundry machine according to a preferred embodiment of the present invention.

First, as shown in the flow chart of FIG. 3, a steam washing course for washing laundry only using steam is selected by the input unit 100 (S100). Specifically, the steam washing course is selected by the course selection part 110 of the input unit 100.

When the steam washing course is selected as described above, the control unit 500 controls the operation display part 140 such that the operation display part 140 informs a user of the start of the steam operation. Of course, the operation display part may inform the user whether the operation based on the steam washing course is currently being carried out or has terminated. Generally, the operation display part 140 performs a function to provide the user with information related to the steam washing course.

Subsequently, the input unit 100 controls the load amount display part 150 to request the selection of the load amount of the laundry (S200). Here, the information displayed on the load amount display part 150 is the information of the basic predetermined load amount. Here, the load amount selection requesting step may be repeatedly carried out until the load amount is selected by the user, or may be set to a predetermined value after a predetermined period of time. In this case, the steam washing may be carried out under the predetermined operation condition, irrespective of the load amount, in the following operation, which will be described below.

In this case, the user can manipulate the load amount selection part 120 to designate how many pieces of laundry are actually put in the drum 12. For example, when two pieces of laundry are put in the drum, the user manipulates the load amount selection part 120 such that the load amount displayed on the load amount selection part 120 becomes two.

However, it is also possible to automatically transmit the load amount of the laundry to the control unit 500 through the load amount detecting sensor mounted in the laundry machine.

Here, the load amount of the laundry to be washed using the steam is an initial factor for deciding operation conditions in which the operation based on the steam washing course is performed. Specifically, various conditions in which the operation is actually performed are differently decided depending upon the load amount of the laundry.

Also, when the steam washing course is selected as described above, it is most preferable to perform a control operation such that other manipulation buttons except the course selection part 110 and the load amount selection part 120 are not manipulated. This is to prevent consumers from being confused due to the selection of the functions which are not related to the operation based on the steam washing course.

After the selection of the initial factor for performing the steam washing course according to the above-described process, for example, the selection of the load amount is completed, the control unit 500 decides an operation condition for the operation based on the steam washing course according to the selected load amount (S300).

At this time, the operation condition for the steam washing operation includes at least one of the amount of water supplied to the steam supply unit 200, the interior temperature of the tub or the drum necessary to perform the operation based on the steam washing course, the operation time of the steam washing course, the steam supply cycle, the rotating speed of the drum, and the alternating rotation cycle of the drum.

Here, the amount of water supplied is decided such that the amount of water supplied can be increased or decreased in proportion to the selected load amount of the laundry.

For example, when the load amount of the laundry is greater than the basic predetermined load amount, the amount of water supplied is preferably decided such that the amount of water supplied is greater than a basic predetermined amount of water supplied. When the load amount of the laundry is less than the basic predetermined load amount, on the other hand, the amount of water supplied is preferably decided such that the amount of water supplied is less than the basic predetermined amount of water supplied. This is to supply the optimum amount of steam to the laundry.

Also, the operation temperature necessary to perform the operation based on the steam washing course is decided such that the operation temperature is relatively high or low in proportion to the selected load amount of the laundry.

For example, when the load amount of the laundry is greater than the basic predetermined load amount, the operation temperature is preferably decided such that the operation temperature is greater than a basic predetermined operation temperature. When the load amount of the laundry is less than the basic predetermined load amount, on the other hand, the operation temperature is preferably decided such that the operation temperature is less than the basic predetermined operation temperature. This is because the temperature of the steam is relatively high, and therefore, the interior temperature of the tub or the drum is increased as the amount of the steam supplied is increased.

Also, the operation time of the steam washing course is decided such that the operation time is relatively long or short in proportion to the selected load amount of the laundry.

For example, when the load amount of the laundry is greater than the basic predetermined load amount, the operation time is preferably decided such that the operation time is longer than a basic predetermined operation time. When the load amount of the laundry is less than the basic predetermined load amount, on the other hand, the operation time is preferably decided such that the operation time is shorter than the basic predetermined operation time.

After the respective operation conditions for steam washing through the above-described process are decided, the control unit 500 performs the operation based on the steam washing course while the control unit 500 controls at least one of the steam supply unit 200, the water supply unit 300, the drum drive unit 400, the temperature detection unit 630, the water level detection unit 610, and the water level detection unit 610 according to the respective decided operation conditions (S400).

Figure 4:
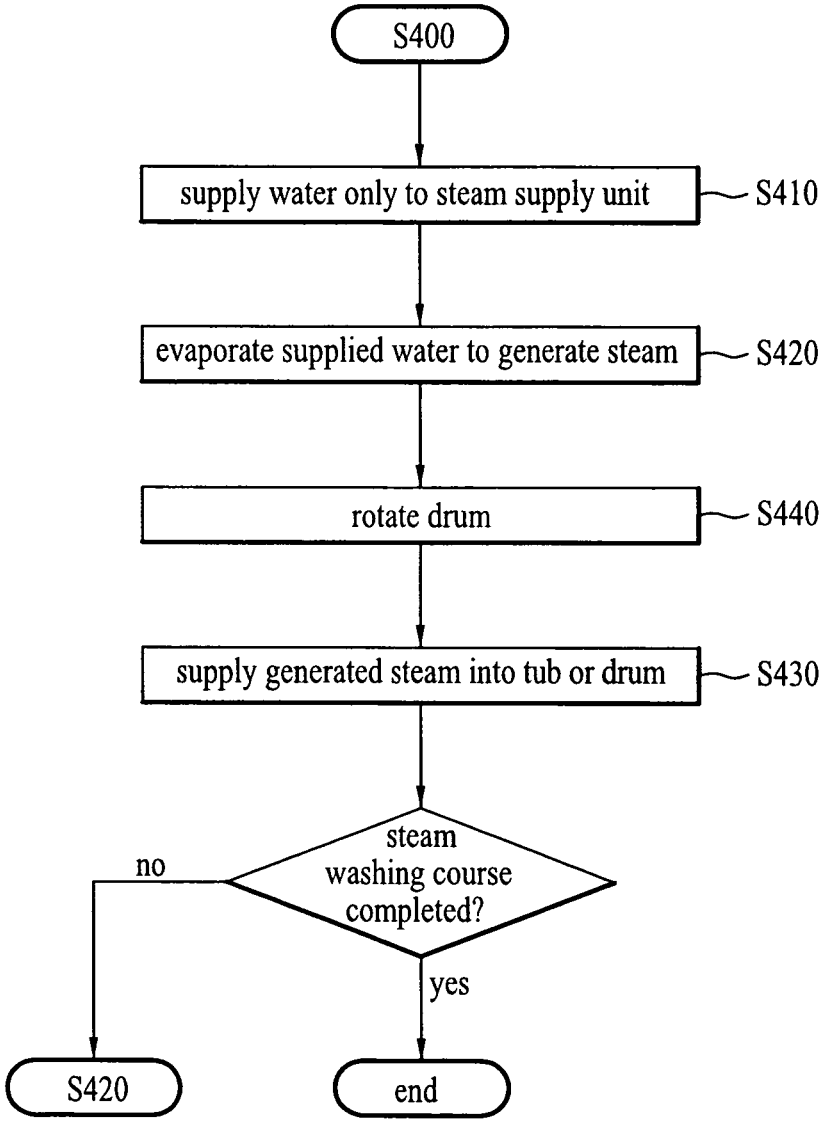
FIG. 4 is a flow chart schematically illustrating a process for performing a steam washing course in the steam washing method for the laundry machine according to the preferred embodiment of the present invention.

The operation based on the steam washing course will be described hereinafter in more detail with reference to the flow chart of FIG. 4.

First, the operation based on the steam washing course is performed through a water supply step (S410), a steam generation step (S420), and a steam supply step (S430).

The respective steps will be described below in more detail.

The water supply step (S410) is a step of supplying water, which will be used to generate steam, to the steam supply unit.

To this end, the control unit 500 controls the water supply valve 310 constituting the water supply unit 300 such that the water can be supplied into the case 210 of the steam supply unit 200. Here, it is preferable to control the water supply unit 300 such that the washing water cannot be supplied into the tub. This is because the laundry is washed only using the steam at the steam washing course.

More specifically, it is preferable that the water is not supplied into the tub 11 through the control of the flow-channel valve 320 when the water is supplied to the steam supply unit 200. This is because, when the water is supplied into the tub 11, the laundry in the drum 12 is wetted by the water supplied into the tub, and therefore, the steam supply effect is decreased due to the water supplied into the tub. This is also because water has a relatively large thermal capacity.

The steam generation step (S420) is a step of evaporating the water supplied to the steam supply unit 200 to generate steam. This steam generation step is carried out after the water supply step (S410) is completed.

Specifically, after the water supply step (S410) is completed, the control unit 500 drives the heater 220 constituting the steam supply unit 200. As a result, the water supplied into the case 210 is evaporated to generate steam.

The steam supply step (S430) is a step of supplying the steam generated through the steam generation step (S420) to the tub 11 or the drum 12.

Specifically, after the steam is generated through the steam generation step (S420), the control unit 500 performs a control operation such that the steam can be supplied into the tub 11 or the drum 12 through the steam supply pipe 212.

Consequently, the temperature and the humidity in the drum 12 are increased due to the steam, and simple contaminants are removed from the laundry in the drum 12 (for example, small stains become faint) due to the high-temperature steam. In this way, the laundry is washed in the drum. Of course, smells are also removed from the laundry.

While the operation based on the steam washing course is carried out, on the other hand, it is preferable to further include a tumble step (S440) of controlling the drum drive unit 400 to rotate the drum 12. This is to uniformly supply the steam to all of the laundry in the drum 12.

Preferably, the tumble step (S440) is controlled such that the tumble step is carried out simultaneously with the steam supply step (S430) at least for a predetermined period of time. Especially, it is most preferable that the tumble step (S440) be started before the steam supply step (S430) is carried out, and be terminated after the steam supply step (S430) is completed.

Of course, the tumble step (S440) may be carried out for the same period of time as the steam supply step (S430), or may be carried out when the steam generation step (S420) or the water supply step (S410) is carried out.

Especially, it is most preferable that the drum 12 be rotated at a speed of 40 rpm to 50 rpm during the tumble step (S440). This is because the steam can be uniformly supplied to the laundry and because the laundry can be smoothly lifted to the upper space in the drum 12 while being placed on the inner wall of the drum 12 and then smoothly falls from the upper space in the drum.

Also, it is most preferable to drive the drum 12 such that the drum 12 can be alternately rotated in opposite directions based on a predetermined time cycle. This is to prevent the laundry from being tangled and to uniformly supply steam to all of the laundry, thereby maximizing the steam washing efficiency.

At this time, it is most preferable that the off time of the drum drive unit 400 is minimized when the drum is alternately rotated in the opposite directions, and, specifically, the off time is set to a time at which the load applied to the drum drive unit 400 is minimized. In the preferred embodiment of the present invention, the time is approximately 3 to 6 seconds (most preferably, approximately 4 seconds).

On the other hand, it is preferable that the operation time of the steam washing course be differently set according to the load amount of the laundry as described above. For example, when the load amount is large, the operation based on the steam washing course is carried out for a relatively long period of time, and, when the load amount is small, the operation based on the steam washing course is carried out for a relatively short period of time.

Of course, it is preferable that the operation temperature of the steam washing course be also set differently depending upon the load amount of the laundry. For example, when the load amount is large, the operation based on the steam washing course is carried out in a relatively high-temperature environment, and, when the load amount is small, the operation based on the steam washing course is carried out in a relatively low-temperature environment.

Figure 5:
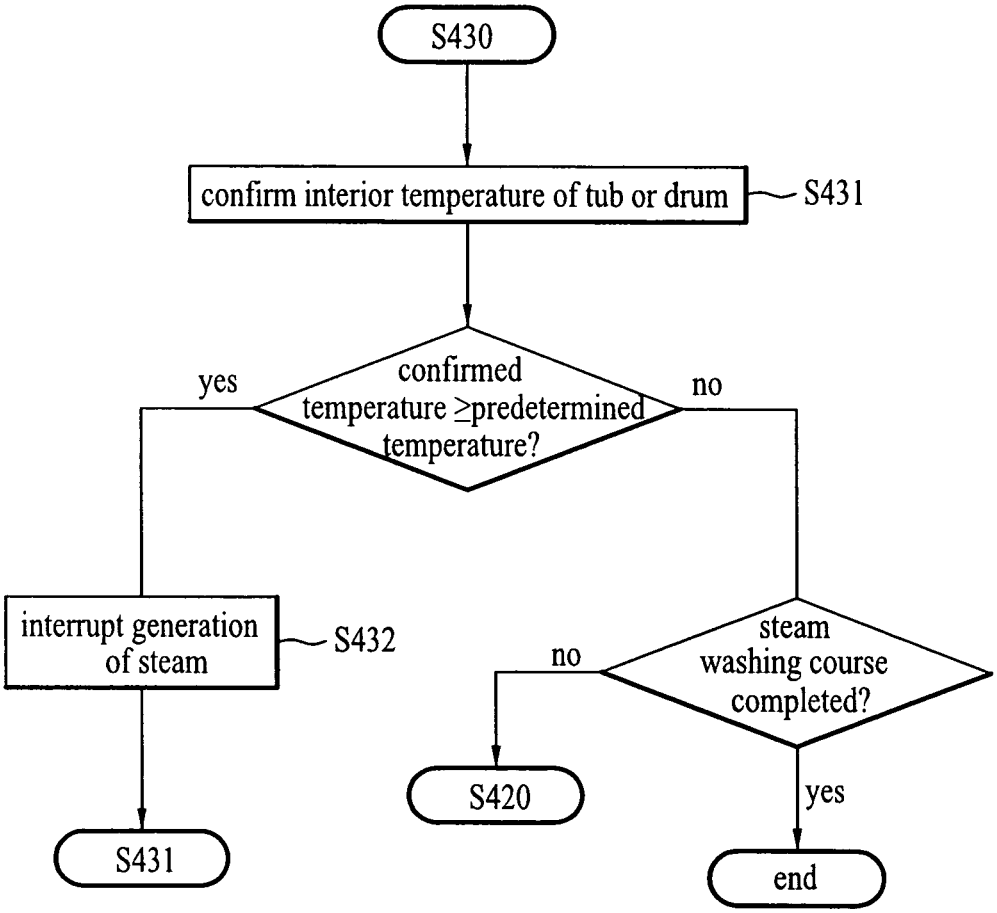
FIG. 5 is a flow chart schematically illustrating a process for controlling a steam supplying unit based on temperature in the steam washing method for the laundry machine according to the preferred embodiment of the present invention.

The flow chart of FIG. 5 illustrates a process of controlling the steam supply unit 200 through the detection of the interior temperature of the tub 11 or the drum 12 during the steam washing course.

Here, the confirmation of the operation temperature is accomplished by the temperature detection unit 630. The interior temperature of the tub 11 or the drum 12 is continuously detected by the temperature detection unit 630 (S431), and the detected interior temperature is transmitted to the control unit 500.

In this case, the control unit 500 repeatedly performs on/off control of the heater 220 constituting the steam supply unit 200 based on the temperature information transmitted to the control unit.

Specifically, when the detected temperature is equal to or higher than the predetermined temperature (the temperature decided depending upon the load amount), the heater 220 is turned OFF such that the steam generation is interrupted. When the detected temperature is lower than the predetermined temperature (the temperature decided depending upon the load amount), on the other hand, the heater 220 is turned ON such that the steam can be continuously generated.

Consequently, the laundry in the drum 12 is sterilized while simple contaminants are removed from the laundry by the high-temperature steam. In this way, the laundry is washed. At this time, when a contaminant-transfer cloth (not shown) is provided in the drum 12 together with the laundry, the simple contaminants attached to the laundry are transferred to the contaminant-transfer cloth, and therefore, the simple contaminants are completely removed from the laundry.

On the other hand, it is preferable that the washing water in the tub does not exceed a predetermined water level while the operation based on the steam washing course is performed. At this time, the predetermined water level may be a water level lower than the height of the drum 12. This is because the decrease of the temperature in the tub 11 or the drum 12 due to the washing water is prevented and the laundry in the drum 12 is prevented from being wetted by the washing water. Of course, the predetermined water level may be lower than the height of the drum 12. In other words, this is to prevent the decrease of the steam supply effect due to the thermal capacity of the water as described above.

Figure 6:
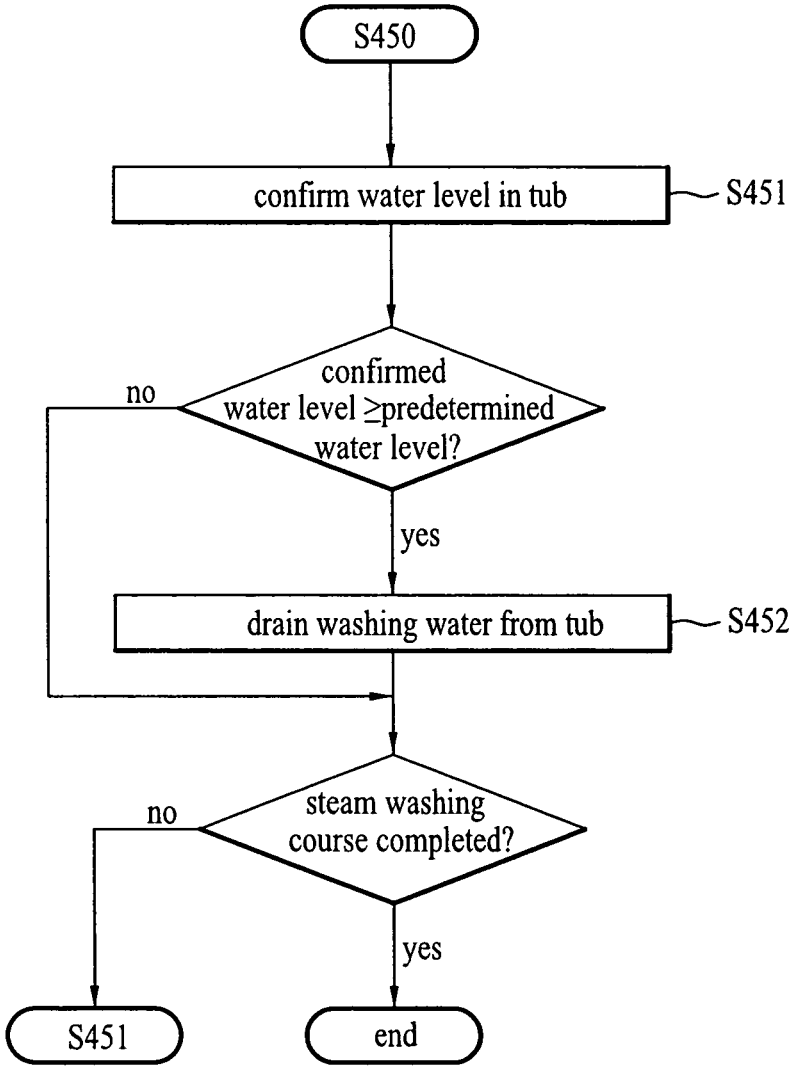
FIG. 6 is a flow chart schematically illustrating a process for controlling a water draining unit based on water level in the steam washing method for the laundry machine according to the preferred embodiment of the present invention.

Consequently, as shown in the flow chart of FIG. 6, the operation based on the steam washing course according to the preferred embodiment of the present invention further includes a water draining step (S450) of confirming the water level in the tub 11 and controlling the water draining unit 620, when the confirmed water level is higher than the predetermined water level, to drain the water from the tub 12.

Specifically, the water level in the tub 11 is confirmed by the water level detection unit 610 (S451), and, when it is confirmed that the washing water in the tub exceeds the predetermined water level, the control unit 500 controls the water draining pump 622 of the water draining unit 620 such that the washing water can be drained from the tub 11 (S452).

Especially, the water draining step (S450) may be carried out before the steam supply step (S430) of the steam washing course is carried out, or otherwise may be carried out continuously while the steam supply step (S430) is carried out. In other words, the water draining step may be carried out at any time during the steam washing operation.

After the steam washing course is carried out for the predetermined operation time according to the load amount of the laundry, the heater 220 constituting the steam supply unit 200 is turned off, and the corresponding operation is terminated.

On the other hand, the user may not recognize whether the steam washing course is terminated although the steam washing course is completed as described above. In this case, the laundry may be left as it is for a long period of time, and therefore, the laundry may be wrinkled.

Figure 7:
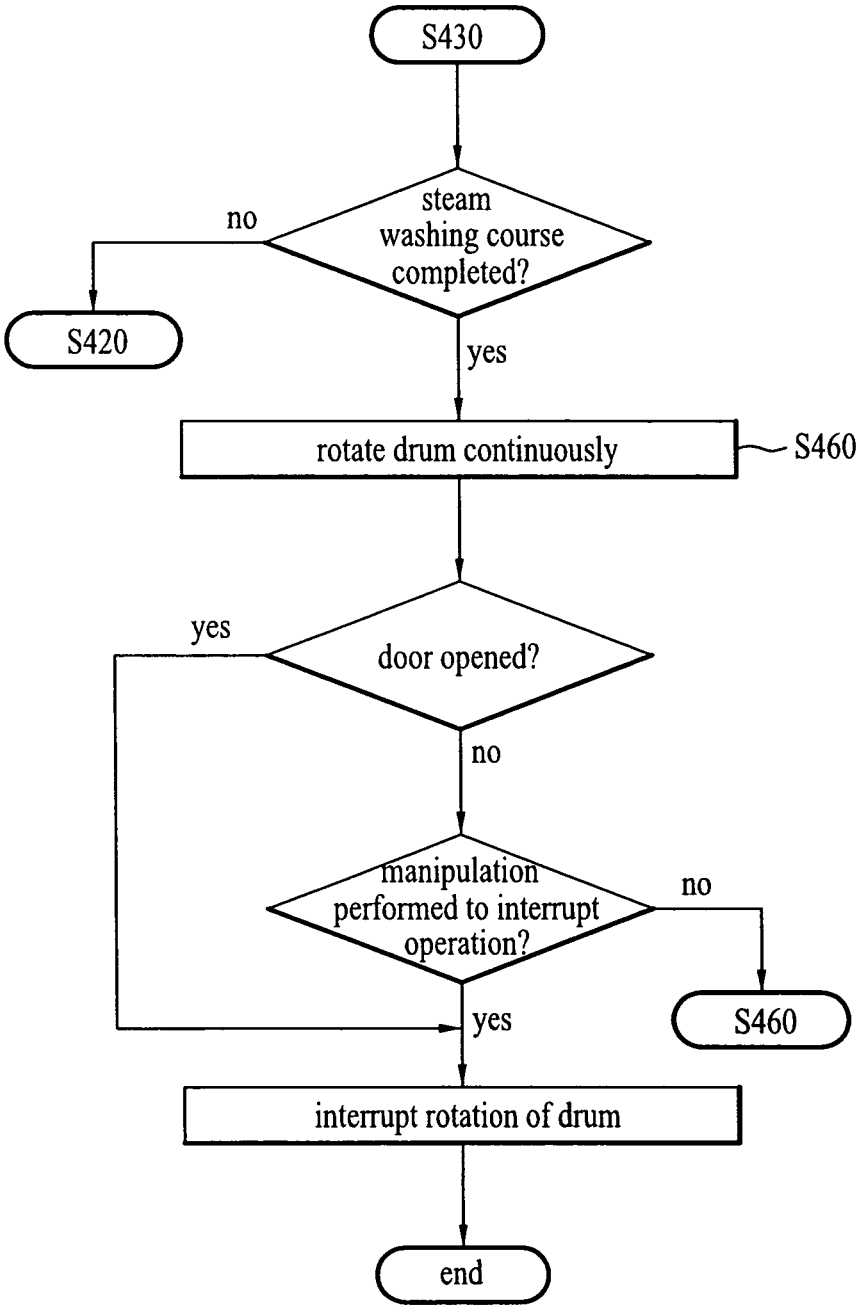
FIG. 7 is a flow chart schematically illustrating a control process after the steam washing course is completed in the steam washing method for the laundry machine according to the preferred embodiment of the present invention.

For this reason, it is preferable to further include a drum rotation step (S460) of rotating the drum 12 after the steam washing completed as shown in the flow chart of FIG. 7.

At this time, it is preferable that the rotation of the drum 12 be performed for a predetermined time cycle or continuously until the user opens a door (not shown) of the laundry machine or manipulates the control assembly 100 to interrupt the rotation of the drum.

A steam washing method according to another preferred embodiment of the present invention will be described hereinafter in detail with reference to FIGS. 8 to 10. This embodiment is characterized in that the initial factor for deciding the operation conditions is different from that of the previously described embodiment although the same laundry machine as the previously described embodiment can be used in this embodiment.

Specifically, the previously described embodiment is characterized in that the initial factor for deciding the operation conditions in which the operation based on the steam washing course is performed is the load amount of the laundry initially received in the drum, whereas this embodiment is characterized in that the initial factor for deciding the operation conditions in which the operation based on the steam washing course is performed is the initial interior temperature of the tub or the drum. Consequently, it is required that a temperature detection unit 630 be mounted in the laundry machine, to which this embodiment is applied. Of course, the temperature detection unit 630 is constructed such that the temperature detection unit 630 detects the interior temperature of the tub 11 or the drum 12, and transmits the detected value to the control unit 500. Preferably, the temperature detection unit 630 is a normal temperature sensor.

Now, a steam washing process using the laundry machine according to the previously described embodiment of the present invention will be described. Specifically, the laundry machine operating method according to this embodiment, which is carried out using the previously described laundry machine, will be described with reference to the flow charts of FIG. 3 to 5.

Figure 8:
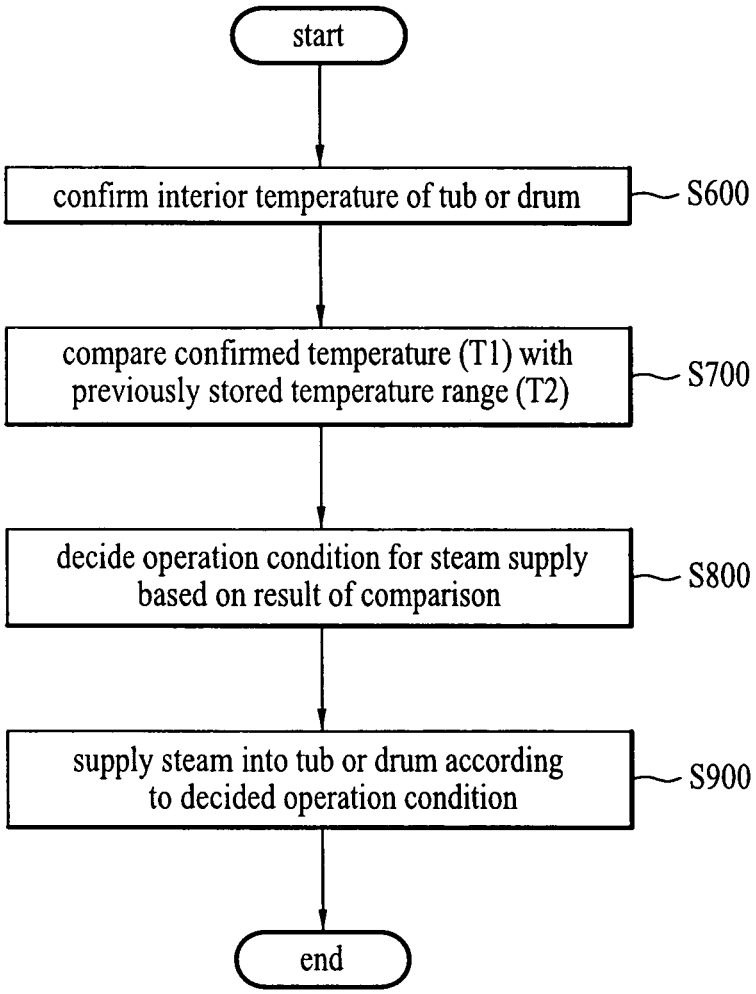
FIG. 8 is a flow chart schematically illustrating an operation method of a laundry machine according to another preferred embodiment of the present invention.

First, as shown in the flow chart of FIG. 8, the operating method according to this embodiment of the present invention includes a temperature confirmation step (S600), a temperature comparison step (S700), an operation condition decision step (S800), and a steam supply step (S900). Here, the steam supply step means a steam washing operation step.

The respective steps will be described hereinafter in more detail in the order of the process.

First, when a user selects the steam washing course, the input unit 500 performs the temperature confirmation step (S600) of confirming the initial interior temperature T1 of the tub 11 or the drum 12.

Figure 9:
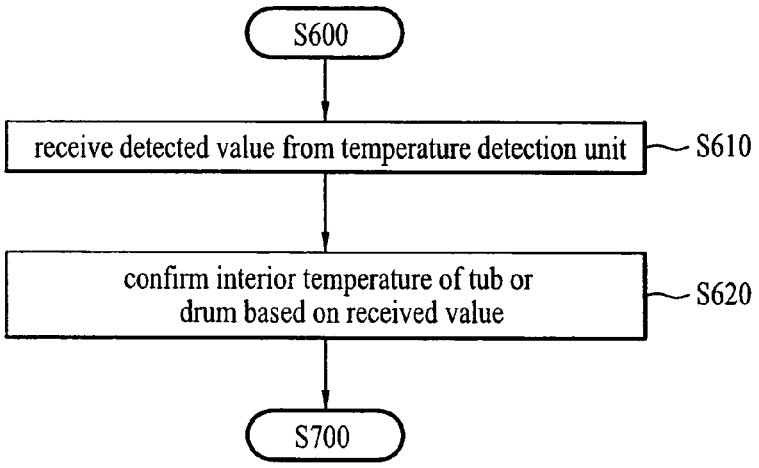
FIG. 9 is a flow chart schematically illustrating a temperature confirmation step in the operation method of the laundry machine according to the preferred embodiment of the present invention.
Figure 10:
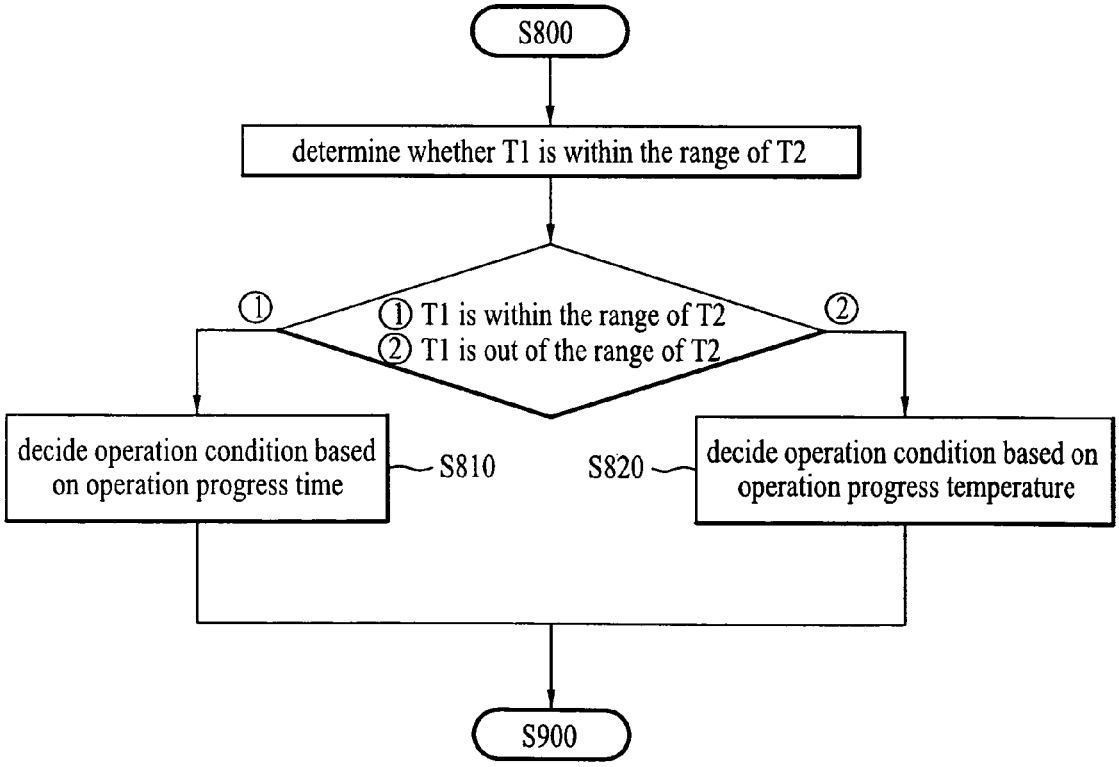
FIG. 10 is a flow chart schematically illustrating an operation condition decision step in the operation method of the laundry machine according to the preferred embodiment of the present invention.

At this time, the temperature confirmation step (S600) includes a detected value reception sub-step (S610) in which the control unit 500 receives the detected value from the temperature detection unit 700, and a interior temperature confirmation sub-step (S620) in which the control unit 500 confirms the interior temperature of the tub 11 or the drum 12 based on the detected value transmitted to the control unit, as shown in FIG. 9.

Especially, it is preferable that the temperature confirmation step (S600) is carried out after any one washing course using the steam is selected by the course selection part 110 of the control assembly 100.

After the interior temperature of the tub 11 or the drum 12 is confirmed at the temperature confirmation step (S600), the control unit 500 performs the temperature comparison step (S200).

At the temperature comparison step (S200), the confirmed temperature T1 is compared with a predetermined reference temperature range T2.

At this time, the predetermined reference temperature range T2 is information stored in the control unit 500. The predetermined reference temperature range is approximately 10 to 30° C. Most preferably, the predetermined reference temperature range T2 is set to 15 to 25° C.

After the temperature comparison step (S700) is completed, the control unit 500 performs the operation condition decision step (S800).

The operation condition decision step (S800) is carried out such that the operation conditions for supplying steam are decided differently according to the results of the comparison carried out at the temperature comparison step (S700). At this time, the operation conditions include at least one of the operation progress temperature and the operation progress time.

Here, the operation conditions are decided differently according to the interior temperature of the tub or the drum.

The operation condition decision step of deciding the operation conditions for supplying the steam differently according to the results of the comparison carried out at the temperature comparison step (S700) will be described hereinafter in more detail with reference to the flow chart of FIG. 10.

First, the results of the comparison carried out at the temperature comparison step (S700) may be divided into two cases.

Specifically, the comparison results are divided into a case that the temperature T1 confirmed at the temperature confirmation step (S600) is within the reference temperature range T2 stored in the control unit 500 (for example, the temperature is not less than 15° C. and not greater than 25° C.), and another case that the temperature T1 confirmed at the temperature confirmation step (S600) is out of the reference temperature range stored in the control unit 500 (for example, the temperature is less than 15° C. or greater than 25° C.).

When the temperature T1 confirmed at the temperature confirmation step (S600) is within the reference temperature range T2 stored in the control unit 500 (for example, the temperature is not less than 15° C. and not greater than 25° C.), the operation condition is decided based on the operation progress time (S810).

This is because, since the interior temperature of the tub 11 or the drum 12 is the room temperature, the range of fluctuation in the steam supply time due to the external factors is very slight, and furthermore, the total washing time can be accurately decided, with the result that the reliability of use for the user is maximally satisfied.

When the temperature T1 confirmed at the temperature confirmation step (S600) is out of the reference temperature range T2 stored in the control unit 500 (for example, the temperature is less than 15° C. or greater than 25° C.), on the other hand, the operation condition is decided based on the operation progress temperature (S820).

This is because, when the operation condition is decided based on the operation progress time although the interior temperature of the tub 11 or the drum 12 is less than 15° C., the interior temperature of the tub 11 or the drum 12 does not reach the temperature necessary to perform the operation using the steam within the operation progress time, and therefore, the steam efficiency is remarkably decreased, whereas, when the operation condition is decided based on the operation progress time although the interior temperature of the tub 11 or the drum 12 is greater than 25° C., the interior temperature of the tub 11 or the drum 12 exceeds the temperature necessary to perform the operation using the steam before the operation progress time elapses, and therefore, the laundry may be deformed.

Also, the operation progress time or the operation progress temperature is decided differently according to the load amount of the laundry (for example, the number of clothes).

Specifically, when the load amount of the laundry is greater than the basic predetermined load amount, the operation progress time is decided such that the operation progress time is relatively long, or the operation progress temperature is decided such that the operation progress temperature is relatively high.

At this time, it is preferable that the load amount of the laundry be selected by the user's manipulation of the load amount selection part 120. Of course, the load amount of the laundry may be automatically confirmed by measuring the load amount of the drum drive unit 400.

On the other hand, after the operation condition decision step (S800) is carried out through the above-described process, the control unit 500 performs a steam supply step (S400). That is to say, the steam washing operation is carried out.

At the steam supply step (S400), the steam is supplied into the tub 11 or the drum 12 according to the operation condition decided at the operation condition decision step (S300).

At this time, the control unit 500 performs the steam supply step (S900) while controlling the steam supply unit 200.

Specifically, the heater 220 of the steam supply unit 200 is driven such that the water supplied into the case 210 is evaporated to generate steam, and the generated steam is supplied into the tub 11 or the drum 12.

At this time, the heating control of the heater 220 is carried out based on the operation progress temperature or the operation progress time decided at the operation condition decision step (S800).

For example, when the operation condition is decided to be the operation progress temperature (for example, 40° C.) at the operation condition decision step (S800), the heating control of the heater 220, i.e., the on/off control of the heater 220, is carried out such that the interior temperature of the tub 11 or the drum 12 is maintained at 40° C.

When the operation condition is decided to be the operation progress time (for example, 4 minutes) at the operation condition decision step (S800), on the other hand, the heating control of the heater 220, i.e., the on/off control of the heater 220, is carried out such that the steam is supplied for 4 minutes.

After the temperature confirmation step (S600), the temperature comparison step (S700), the operation condition decision step (S800), and the steam supply step (S900) are successively completed, the operation based on the steam washing course is terminated.

Meanwhile, the operation conditions decided at the operation condition decision step (S300) of the operation method according to this embodiment of the present invention may further include the level of water supplied to the steam supply unit 200, i.e., the water supply level. This is because the amount of steam supplied is changed depending the water supply level, and the operation progress temperature is changed depending upon the amount of steam supplied. Especially, the water supply level is decided differently depending upon the load amount of the laundry. Specifically, as the load amount of the laundry is increased, the water supply level is decided such that the water supply level is relatively high.

At this time, it is preferable that the load amount of the laundry be selected by the user. Of course, the load amount of the laundry may be automatically confirmed by measuring the load amount of the drum drive unit 400. Also, in the case that the operation condition is decided based on the water supply level, the water supply based the decided water supply level is carried out under the control of the water supply unit 300. Of course, it is most preferable to decide the operation condition in combination with the operation progress temperature or the operation progress time as compared to the decision of the operation condition based on only the water supply level.

INDUSTRIAL APPLICABILITY

The steam washing method according to the present invention provides the following effects.

First, the steam washing method and the laundry machine according to the present invention have the effect of easily washing a small amount of laundry only using steam.

Secondly, the steam washing method and the laundry machine according to the present invention have the effect of deciding the operation condition for the steam washing course differently depending upon the load amount of the laundry and then performing the steam washing operation based on the decided operation condition, thereby accomplishing the optimum steam washing.

Thirdly, the steam washing method and the laundry machine according to the present invention have the effect of deciding the operation condition for the steam washing course differently depending upon the initial interior temperature of the tub or the drum and then performing the steam washing operation based on the decided operation condition, thereby accomplishing the optimum steam washing.

Fourthly, the steam washing method and the laundry machine according to the present invention have the effect of washing a small amount of laundry having a relatively low contamination level or removing only smells from the laundry while consuming minimal power and washing water.

What is claimed is:

1. A method of operating a laundry machine comprising:

sensing that a selected course at a first selector is a course using steam as an only water based substance entering a tub or a drum for cleaning the laundry from a plurality of courses which includes various washing courses for washing laundry using liquid water supplied into the tub or the drum;

enabling a steam generator to generate and supply steam to the tub or the drum; and performing the selected course by using only the steam entering the tub or the drum for cleaning the laundry, wherein, at the performing the selected course, an operation condition of the selected course is decided according to an initial factor, where the initial factor includes at least an initial interior temperature of the tub or the drum, wherein the operation condition is decided depending upon a result of comparison between the initial interior temperature and a reference temperature range, and the operation condition includes at least one of an operation progress temperature of the interior the tub or the drum and an operation progress time, in order to decide and control an amount of steam to be supplied to the tub or the drum, wherein when the initial interior temperature is within the reference temperature range, the operation condition is decided based on the operation progress time, and when the initial interior temperature is out of the reference temperature range, the operation condition is decided based on the operation progress temperature.

2. The method according to claim 1, further comprises displaying on a display that the selected course is the course using steam or the course using steam is being performed.

3. The method according to claim 1, further comprises displaying on a display information corresponding to operation of the selected course using steam.

4. The method according to claim 1, further comprises disabling selection of functions not associated with at least one course using steam.

5. The method according to claim 1, the method further comprising:

determining the amount of laundry in the drum; and causing the steam generator to generate steam in proportion to the determined amount of laundry.

6. The method according to claim 5, wherein determining the amount of laundry includes sensing an entry at an input device corresponding to the laundry amount.

7. The method according to claim 5, wherein determining the amount of laundry includes sensing the amount of laundry in the drum using a sensor.

8. The method according to claim 1, wherein the operation condition further includes at least one of the amount of water supplied to the steam generator, an interior temperature of the tub or the drum necessary to perform an operation based on the steam course, an operation time of the steam course and a steam supply cycle.

9. The method according to claim 1, wherein, when the operation condition is decided based on the operation progress temperature, an amount of steam is supplied to the tub or the drum until an interior temperature of the tub or the drum reaches the operation progress temperature.

10. The method according to claim 9, wherein the operation progress temperature is decided such that the operation progress temperature is increased in proportion to an increase in the load amount of the laundry.

11. The method according to claim 1, wherein, when the operation condition is decided based on the operation progress time, steam is supplied to the tub or the drum for a duration equal to the operation progress time.

12. The method according to claim 11, wherein the operation progress time is decided such that the operation progress time is increased in proportion to an increase in the load amount of the laundry.

13. The method according to claim 1, wherein the operation condition includes an operation progress temperature when the initial interior temperature is out of the reference temperature range.

14. The method according to claim 13, wherein the operation progress temperature, depends upon a load amount of the laundry.

15. The method according to claim 1, further comprises tumbling the laundry in the tub or the drum.

16. The method according to claim 15, further comprises starting the tumbling of the laundry in the tub or the drum before the steam is supplied to the tub or the drum.

17. The method according to claim 15, further comprises terminating the tumbling of the laundry in the tub or the drum after the steam is supplied to the tub or the drum.

18. The method according to claim 15, further comprises tumbling the laundry in the tub or the drum clockwise and counter clockwise based on a predetermined time cycle.

19. The method according to claim 1, further comprising:

sensing water in the tub or the drum; and draining water in the tub or the drum when the water reaches a predetermined level.

20. The method according to claim 1, further comprises draining water formed in the tub or the drum.

21. The method according to claim 1, further comprises tumbling the tub or the drum after the selected course is terminated and until a door of the laundry machine is opened.

22. The method according to claim 1, wherein the operation condition includes the operation progress time when the initial interior temperature is within the reference temperature range.

23. The method according to claim 22, wherein operation progress time depends upon a load amount of the laundry.

24. The method according to claim 22, wherein the reference temperature range is 10 to 30° C.

25. A laundry machine comprising:

a steam generator to generate steam;

a first selector to select a course using steam as an only water based substance entering a tub or a drum for cleaning the laundry from a plurality of courses which includes various washing courses for washing laundry using liquid water supplied into the tub or the drum; and a controller configured to decide an operation condition and the selected course, wherein the controller is configured to enable the steam generator to generate steam so that only the steam is supplied to the tub or the drum for cleaning the laundry when the selector indicates to the controller that the selected course is a course using steam, wherein, at the performing the selected course, the operation condition of the selected course is decided according to an initial factor, where the initial factor includes at least an initial interior temperature of the tub or the drum, wherein the operation condition is decided depending upon a result of comparison between the initial interior temperature and a reference temperature range, and the operation condition includes at least one of an operation progress temperature of the interior the tub or the drum and an operation progress time, in order to control an amount of steam to be supplied to the tub or the drum, and wherein when the initial interior temperature is within the reference temperature range, the operation condition is decided based on the operation progress time, and when the initial interior temperature is out of the reference temperature range, the operation condition is decided based on the operation progress temperature.

26. The laundry machine according to claim 25, further comprises a display to display that the selected course is the course using steam or the course using steam is being performed.

27. The laundry machine according to claim 25 further comprises a display to display information corresponding to operation of the selected course using steam.

28. The laundry machine according to claim 25, wherein the controller is configured to disable at least a second selector so that a selection of a function not associated with at least one course using steam is disabled.

29. The laundry machine according to claim 25, further comprising:

an input device to enter a value corresponding to an amount of laundry in the drum; and the controller configured to determine the amount of laundry based on an entry at the input device.

30. The laundry machine according to claim 25, further comprising:

a first sensor to sense an amount of laundry the drum; and the controller configured to determine the amount of laundry based on sensed laundry amount.

31. The laundry machine according to claim 25, wherein the operation condition includes at least one of the amount of water supplied to the steam generator, an interior temperature of the tub or the drum necessary to perform an operation based on the steam course, and an operation time of the steam course.

32. The laundry machine according to claim 25, further comprising:

a second sensor to sense an interior temperature of the tub or the drum.

33. The laundry machine according to claim 25, further comprising:

a motor coupled to the tub or the drum; and the controller configured to drive the motor so that the laundry is tumbled in the tub or the drum.

34. The laundry machine according to claim 33, wherein the controller is configured to drive the motor so that the laundry is tumbled in the tub or the drum before the steam is supplied to the tub or the drum.

35. The laundry machine according to claim 33, wherein the controller is configured to drive the motor so that the tumbling of the laundry is terminated after the steam is supplied to the tub or the drum.

36. The laundry machine according to claim 33, wherein the controller is configured to drive the motor to tumble the laundry in the tub or the drum clockwise and counter clockwise based on a predetermined time cycle.

37. The laundry machine according to claim 25, further comprising:

a third sensor to sense a water level in the tub or the drum; and the controller configured to enable a drain valve to drain water in the tub or the drum when the water reaches a predetermined level.

38. The laundry machine according to claim 25, further comprises a drain to drain water formed in the tub or the drum.

39. The laundry machine according to claim 33, wherein the controller is configured to drive the motor so that the laundry is tumbled in the tub or the drum after the selected course is terminated and until a door of the laundry machine is opened.

40. A method of operating a laundry machine comprising:

sensing that a selected course at a first selector is a course using steam as an only water based substance entering a tub or a drum for cleaning the laundry from a plurality of courses which includes various washing courses for washing laundry using liquid water supplied into the tub or the drum;

enabling a steam generator to generate and supply steam to the tub or the drum;

performing the selected course by using only the steam entering the tub or the drum for cleaning the laundry, wherein, at the performing the selected course, an operation condition of the selected course is decided according to an initial factor, where the initial factor includes at least an initial interior temperature of the tub or the drum, wherein when the initial factor is the initial interior temperature of the tub or the drum, the operation condition is decided depending upon a result of comparison between the initial interior temperature and a reference temperature range, wherein the operation condition includes at least one of an operation progress temperature interior of the tub or the drum and an operation progress time, in order to decide and control an amount of steam to be supplied to the tub or the drum;

wherein when the initial interior temperature is within the reference temperature range, the operation condition is decided based on the operation progress time, and when the initial interior temperature is out of the reference temperature range, the operation condition is decided based on the operation progress temperature, wherein, when the operation condition is decided based on the operation progress temperature, an amount of steam is supplied to the tub or the drum until an interior temperature of the tub or the drum reaches the operation progress temperature, wherein the operation progress temperature is decided such that the operation progress temperature is increased in proportion to an increase in the load amount of the laundry.

41. A method of operating a laundry machine comprising:

sensing that a selected course at a first selector is a course using steam as an only water based substance entering a tub or a drum for cleaning the laundry from a plurality of courses which includes various washing courses for washing laundry using liquid water supplied into the tub or the drum;

enabling a steam generator to generate and supply steam to the tub or the drum;

performing the selected course by using only the steam entering the tub or the drum for cleaning the laundry, wherein, at the performing the selected course, an operation condition of the selected course is decided according to an initial factor, where the initial factor includes at least an initial interior temperature of the tub or the drum, wherein when the initial factor is the initial interior temperature of the tub or the drum, the operation condition is decided depending upon a result of comparison between the initial interior temperature and a reference temperature range, and the operation condition includes at least one of an operation progress temperature interior of the tub or the drum and an operation progress time, in order to decide and control an amount of steam to be supplied to the tub or the drum;

wherein when the initial interior temperature is within the reference temperature range, the operation condition is decided based on the operation progress time, and when the initial interior temperature is out of the reference temperature range, the operation condition is decided based on the operation progress temperature, wherein, when the operation condition is decided based on the operation progress time, steam is supplied to the tub or the drum for a duration equal to the operation progress time, wherein the operation progress time is decided such that the operation progress time is increased in proportion to an increase in the load amount of the laundry.

* * * * *